US005222433A

United States Patent [19]

Philipp

[11] Patent Number: 5,222,433

[45] Date of Patent: Jun. 29, 1993

[54] PRINTING IMAGE CARRIER

[75] Inventor: Wilfried Philipp, Kornwestheim, Fed. Rep. of Germany

[73] Assignee: Tampoprint GmbH, Korntal-Muenchingen, Fed. Rep. of Germany

[21] Appl. No.: 970,605

[22] Filed: Oct. 29, 1992

Related U.S. Application Data

[63] Continuation of Ser. No. 753,657, Aug. 30, 1991, abandoned.

[30] Foreign Application Priority Data

Aug. 31, 1990 [DE] Fed. Rep. of Germany ..... 4027587

[51] Int. Cl.[5] ..... B41F 1/00

[52] U.S. Cl. ..... 101/163; 101/477

[58] Field of Search ..... 101/375, 376, 395, 401.1, 101/163, 170, 150, 169, 35, 41, 477

[56] References Cited

U.S. PATENT DOCUMENTS

| | | | |
|---|---|---|---|
| 4,445,998 | 5/1984 | Kanda et al. | 264/385 |
| 4,491,082 | 1/1985 | Barch et al. | 101/375 |
| 4,779,531 | 10/1988 | Ueno et al. | 101/163 |
| 4,895,071 | 1/1990 | Benton | 101/169 |

FOREIGN PATENT DOCUMENTS

| | | | |
|---|---|---|---|
| 0036316 | 9/1981 | European Pat. Off. . | |
| 0101266 | 2/1984 | European Pat. Off. | 101/170 |
| 0191866 | 8/1986 | European Pat. Off. . | |
| 3508920 | 9/1986 | Fed. Rep. of Germany . | |
| 2451829 | 10/1980 | France . | |
| 59-48190 | 7/1984 | Japan . | |
| 7708599 | 2/1979 | Netherlands | 101/376 |
| 7807649 | 2/1979 | Netherlands | 101/376 |

*Primary Examiner*—J. Reed Fisher

*Attorney, Agent, or Firm*—Griffin, Butler, Whisenhunt & Kurtossy

[57] ABSTRACT

An image carrier, more particularly for indirect gravure or pad printing, having a gravure image thereon, comprises a foil image carrier of metal, which has a smooth surface and is able to be mounted on a receiving element of a printing device. The costs of production of the image carrier are substantially reduced since the image carrier is constituted by a smooth and flexible metal foil adapted to make snug engagement with the surface of the element for receiving it.

12 Claims, 3 Drawing Sheets

PRINTING IMAGE CARRIER

This application is a continuation of application Ser. No. 07/753,657, filed Aug. 30, 1991, now abandoned.

BACKGROUND OF THE INVENTION

This invention relates to a printing image carrier, more particularly for indirect gravure or pad printing, of a type in which the carrier, having a gravure image, is a foil image carrier.

Printing image carriers in the form of plates have long been known in the art. Such printing image carriers normally consist of hardened high-alloy tool steel, which is absolutely flat and therefore has to be comparatively thick in order to ensure such flatness. This requirement entails comparatively high costs, more particularly in the case of a relatively large image carrier, since a surface bearing the image has to be lapped and hardened. In some cases a material of the image carrier is artificially aged before machining in order to preclude later warping. Because of the high costs, such steel image carriers produced in this manner can only be utilized economically for big runs of 200,000 prints and more. Owing to comparatively large thicknesses of such steel image carrier plates of up to 10 mm and above, material costs, as such, make themselves felt. Furthermore, costs for shipping and stockholding are relatively high because of the large weights and sizes of the image carriers. Since relatively aggressive inks are frequently employed, it is necessary for a corrosion-resistant steel to be employed as the material for the image carriers, this being a further factor increasing material costs.

For small and medium runs, that is to say for runs of a few hundred, up to 50,000 prints, it is possible to use photopolymer image carriers in place of steel image carriers. Such an image carrier as a rule comprises a backing plate of metal having a plastic-coated surface bearing a gravure image in it. This surface coated with plastic is swept by a doctor in order to remove superfluous ink from the gravure image. Since however the surface of plastic is relatively soft, it is extremely sensitive to the doctor sweeping over it as well as to foreign matter. In fact, foreign matter in printing ink or in the form of dust or dirt on the doctor will lead to scratches in the gravure image and will thereby render the image carrier unusable.

Printing equipment with a closed ink and doctor pot (see European patent publication 140,165 B 1) exclusively requires one of the initially mentioned steel plate image carriers, since only this type has the necessary flat surface, which guarantees a clean printed image with such printing equipment. Surface roughness may, at the most, only be up to 2 microns, because otherwise there is a danger of ink leaking out of the doctor pot. A consequence of this would then be that the machine would be fouled with ink within a short time and that clean printing work would no longer be possible. Because of the small runs possible therewith, such a photopolymer image carrier has the disadvantage that a run frequently has to be interrupted in order to change the image carrier. Such replacement of the image carrier leads to short runs and constant attendance of qualified personnel in order to perform such replacements.

The periodical "Keramische Zeitschrift", 41st year, no. 6, 1989, pages 395 ff, describes an image carrier foil for the ceramics industry. The material applied here comprises ground glass or the like, a large quantity thereof being necessary for each application or, respectively, for each transfer of coloring material. Since such ceramic coloring material is applied in a very thick layer, it is necessary for the gravure image in the carrier itself to have a minimum depth of 70 to 80 microns in order to accept the coloring material and the image carrier must have a corresponding thickness of 0.5 mm to 1 mm even to allow the provision of the gravure image and to endow the image carrier with a necessary stiffness. Such thick image carriers are however relatively stiff and, in the case of line gravure images covering large areas, lead to a disadvantage of a substantial hazard that the gravure doctor will sag into image recesses due to its lack of flatness, even though the surface is completely smooth. Relatively thin printing inks, as are utilized in machines of a type with a closed inking system, however flow through gaps with a depth of 1 micron. It is therefore absolutely necessary for the foil itself to have a constant thickness.

German patent publication 3,412,496 A describes a rotary pad printing device with a foil bound thereon. However there are no details of the foil or the dimensions thereof.

Such image carriers however involve the disadvantage that despite a very high quality ground surface, there is surface roughness of several microns. If such image carriers are utilized in printing equipment with doctor pots, there is then a danger of ink gradually leaking from the doctor pot owing to such unevenness of the surface.

SUMMARY OF THE INVENTION

Accordingly, one object of the invention is to provide an image carrier of the type initially mentioned with which big "runs" may be carried out.

A still further object of the invention is to provide an image carrier for which there are substantially lower costs for production and stocking.

In order to achieve these and/or other objects in accordance with the following specification, claims and figures, an image carrier of this invention is constituted by a flexible metal foil adapted for snug engagement with a surface of an image-carrier receiving element and for compliance with surface contours, such metal foil having a thickness of 0.02 mm to 0.25 mm and more particularly a thickness of 0.07 mm to 0.15 mm, a maximum surface roughness of 3 microns, and more particularly of 2 microns, and a resistance to wear suitable for use with a doctor pot of a hard material.

BRIEF DESCRIPTION OF THE DRAWINGS

The invention and further features and advantages thereof will now be described in more detail with reference to accompanying drawings which show several preferred embodiments thereof and in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
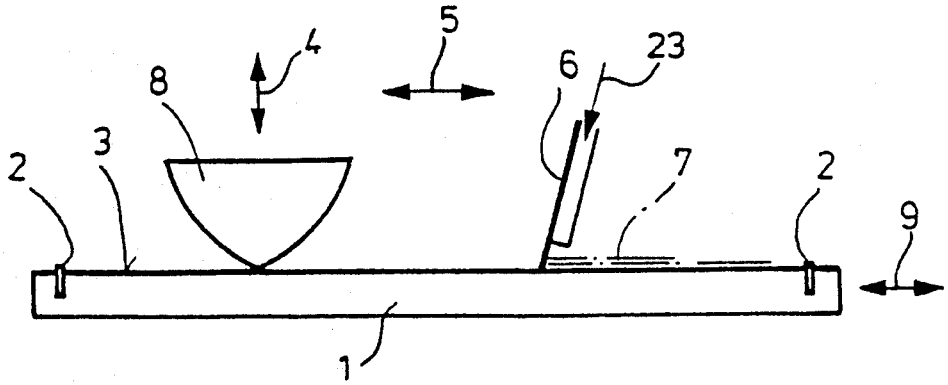
FIG. 1 is a side, schematic, or diagrammatic, view of a first embodiment of foil image carrier of this invention with a doctor for sweeping off surplus ink and a pad at a top surface of an image carrier.

In FIG. 1 a receiving element 1 for an image carrier is to be seen diagrammatically, which consists, for instance, of metal, more particularly of steel, or of stone or glass. This receiving element 1 for the image carrier has a surface with a roughness or unevenness of <2 microns. At margins thereof this image-carrier receiving element is provided with retainer pins 2, which extend slightly above the surface of said image-carrier receiving element 1. These retainer pins 2 hold a foil image carrier 3 by fitting into margin holes or perforations thereof, not illustrated. In another possible form of the invention, not illustrated, the foil is, for example, held by magnetic holding attraction or device(s) on the receiving element 1. The foil image carrier 3 is consequently secured and prevented from slipping on the receiving element 1. Furthermore figure 1 depicts a pad 8 which may be moved as indicated by a two-headed arrow 4 in the vertical direction and which may be further moved horizontally in accordance with a double arrow 5. In addition there is a doctor, or doctor blade, 6, which clears surplus ink 7 from the image carrier. Finally the image carrier bears an engraved image (such as image 22 in FIG. 6) which is positioned underneath the pad 8.

The workings of the device will now be briefly explained. Once the engraved printing image of the image carrier 3 positioned underneath has been inked, the doctor 6 strips excess ink from the engraved image 22 since the receiving element for the image carrier 3 is moved to the left as indicated by an arrow 9. When the carrier receiving element reaches its left terminal position the pad 8 is pressed onto the engraved image and takes up ink from pits engraved in the image carrier 3 in accordance with the image, such ink then adhering to the pad which is of silicone rubber. The pad 8 is then moved upwardly as indicated by the arrow 4 and thereby clears the image carrier 3. The image-carrier receiving element then goes to its right-hand end position as indicated by the arrow 9 and the engraved image is re-inked. Since the receiving element 1 for the image carrier is in its right-hand end position, it is possible for the pad 8 to be shifted downwardly past the plane of the receiving element 1 and be pressed onto an article to be printed located underneath this plane. When the pad 8 has returned back to its upper end position, the image-carrier receiving element 1 moves back to the left end position and, when this happens, the doctor 6 strips surplus ink from the printing image. Since the doctor 6 engages the foil image carrier 3 with a certain thrust 23, the doctor 6 presses the foil image carrier 3 onto the surface of the image-carrier receiving element 1. The foil image carrier 3 is then forced to comply with the contours of this surface. Since this surface is rendered accurately planar, the foil image carrier 3 will also assume a planar form. This ensures that the doctor 6 performs perfect removal of all surplus ink from the surface of the foil image carrier 3 without any ink being left as a residue in any otherwise occurring hollows corresponding to unevenness in the surface. The doctor 6 is of, for instance, high-alloy steel.

Figure 2:
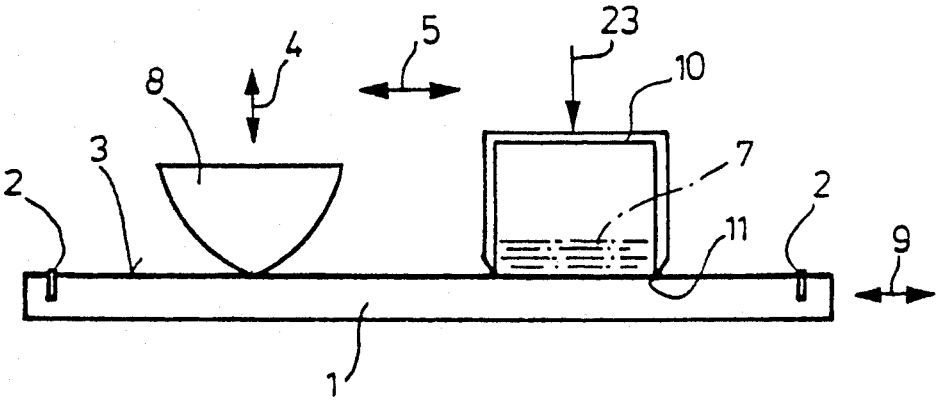
FIG. 2 shows the same arrangement as in FIG. 1, albeit with an ink pot provided at the upper surface of the foil image carrier.

In the case of the arrangement illustrated in figure 2, ink is located in a doctor, or ink, pot, or fountain applicator, 10, which is so arranged that it assumes a position exactly over the engraved image on the image carrier 3 owing to displacement of the receiving element 1. The engraved image then receives ink from the doctor pot 10. If the image-carrier receiving element 1 is now moved back to the left hand end position, the lower edge 11 of the doctor pot 10, will, in the manner of a doctor fountain applicator, sweep over the engraved image and will ensure that ink is only allowed to remain in pits or hollows constituting the printing engraved image. In this case as well the image carrier 3 is pressed against the receiving element 1 by the thrust 23 and the weight of the doctor pot 10 amounting to approximately 10 to 15 kg. When this happens the foil image carrier 3 is brought into such snug engagement with the surface that the foil complies with the contours thereof. Since, as already mentioned, the receiving element 1 for the image carrier is very accurately rendered planar, the foil image carrier 3 will comply with this planar form and it is thus ensured that, there are no depressions caused by unevenness, more particularly at the printing image, in which traces of ink might be retained during doctoring. The satisfactory snug fit of the image carrier is more particularly promoted by a small thickness of the foil 3 of 0.05 mm to 0.15 mm. The surface bearing the printing image of the foil image carrier 3 furthermore has the excellent material properties of a solid steel image carrier. A further point is that the doctor edge 11 of the doctor pot 10 is preferably of cemented carbide or ceramic material and thus in the case of a suitable foil image carrier 3 it is possible to ensure that the surface of the foil image carrier 3 is gradually compacted by the reciprocating doctor pot 10, this being a further factor promoting flatness. Furthermore it is to be noted that the kinematics of the pad 8, the doctor 6 and, respectively, the doctor pot 10 and furthermore the image-carrier receiving element 1 may be modified in a large number of different ways. It is, for instance, possible for the receiving element 1 to be stationarily arranged in the printing device, while the pad 8 and the doctor 6 or, respectively, the doctor pot 10 are moved.

Figure 3:
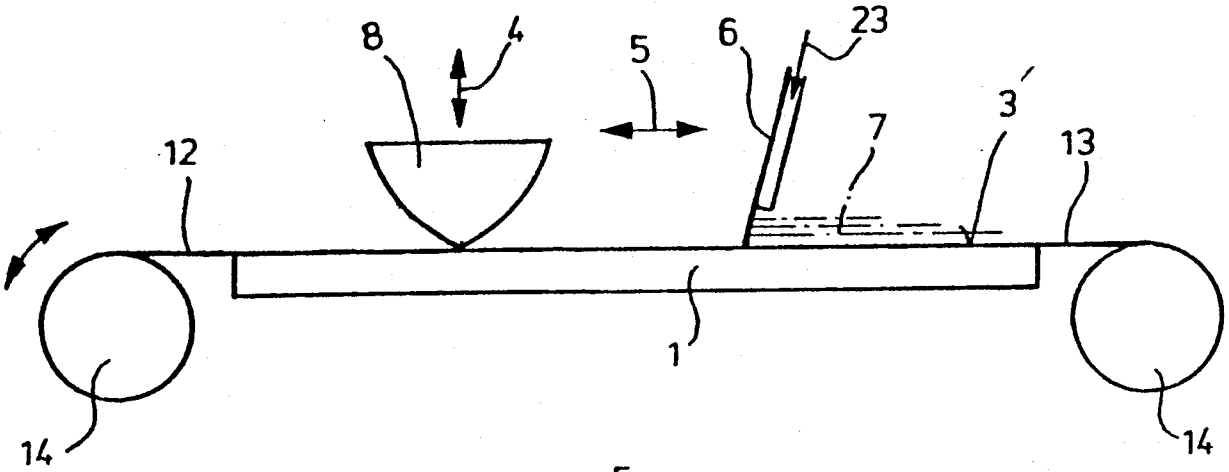
FIG. 3 is a side, schematic, or diagrammatic, view of an image carrier of this invention in the form of a band carrier with a doctor for clearing off surplus ink.
Figure 4:
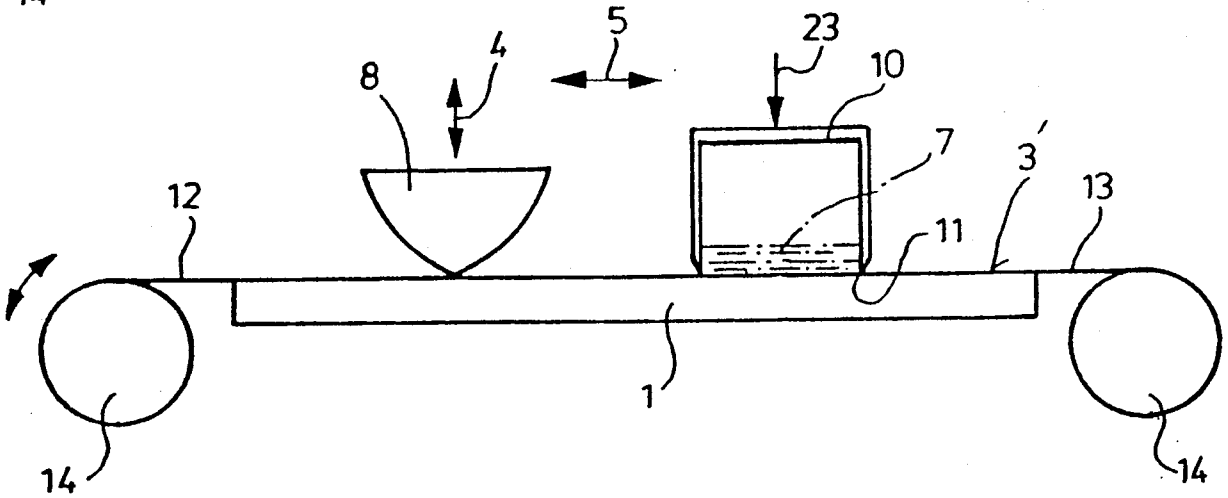
FIG. 4 shows the same arrangement as in FIG. 3 but with an ink pot adjacent to an upper surface of the band image carrier.

In the case of the embodiment of the invention illustrated in FIGS. 3 and 4 a foil image carrier is constituted by an image carrier band. Two ends 12 and 13 of the foil image carrier 3' are wound onto rolls 14 which constitute a foil cassette. This foil image carrier 3' in the form of a band or belt has a plurality of engraved images with a spacing between them in sequence. These engraved images may either have the same image or they may have different ones. In the former case there is the advantage that, although the foil image carrier 3', in accordance with the invention, may inherently be used for very long runs and the replacement thereof is only necessary after a considerable time, such replacement may be performed very rapidly owing to the fact that the foil image carrier 3' is drawn off from the one roll 14 and taken up on the other roll 14. The foil image carrier 3' is, during this operation, moved through one step at a time until a next engraved image is located in the right position. This operation only takes a matter of seconds to perform. Such printing equipment may thus be run overnight or on weekends without attendants being necessary for changing image carriers. If the image is changed there is the advantage that there is a wide variety of images on a single band without the foil image carrier 3' having to be removed. By using a suitable controller the foil image carrier may be moved backwards and forwards using one roll 14 for unwinding and the other roll 14 for winding in such a manner that a desired printing image arrives on the image-carrier receiving element 1. In this respect a single article to be printed upon can have two different prints applied to it alternately. The foil image carrier 3' then constantly runs backwardly and forwardly. In this arrangement, as well, both the doctor 6 and also the doctor pot 10 are pressed with a certain thrust on the foil image carrier 3' so that the same is in snug engagement with the surface of the image-carrier receiving element 1.

Figure 5:
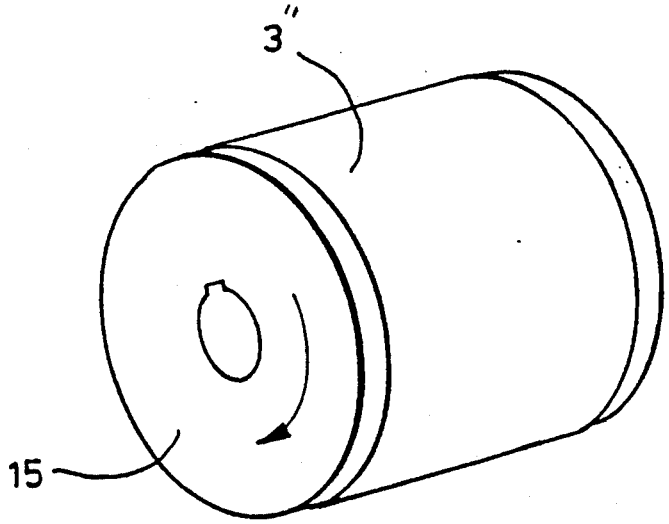
FIG. 5 is a perspective view of a roll of a printing device with a cylindrical foil image carrier of this invention fitted thereto, as seen in perspective.

The arrangement illustrated in FIG. 5 has a holding roll 15 as is more particularly necessary in rotary printing. A foil image carrier 3'' which is designed in the form of a sleeve, is mounted on this cylindrical roll 15 with a highly precision surface. This foil image carrier 3'' may be so designed by a suitable selection of its dimensions that it is tensioned onto the surface of the roll 15 with a snug engagement. In this respect the roll 15 constitutes a receiving element for the image carrier.

In addition the foil image carrier 3'' is pressed onto the surface of the roll 15 by a doctor. In the case of another possible arrangement, not illustrated, the foil image carrier 3'' is held by a suitable holding device on the roll 15. In this case, as well, the foil image carrier 3'' is borne on the surface of the roll 15 and complies with its form.

Figure 6:
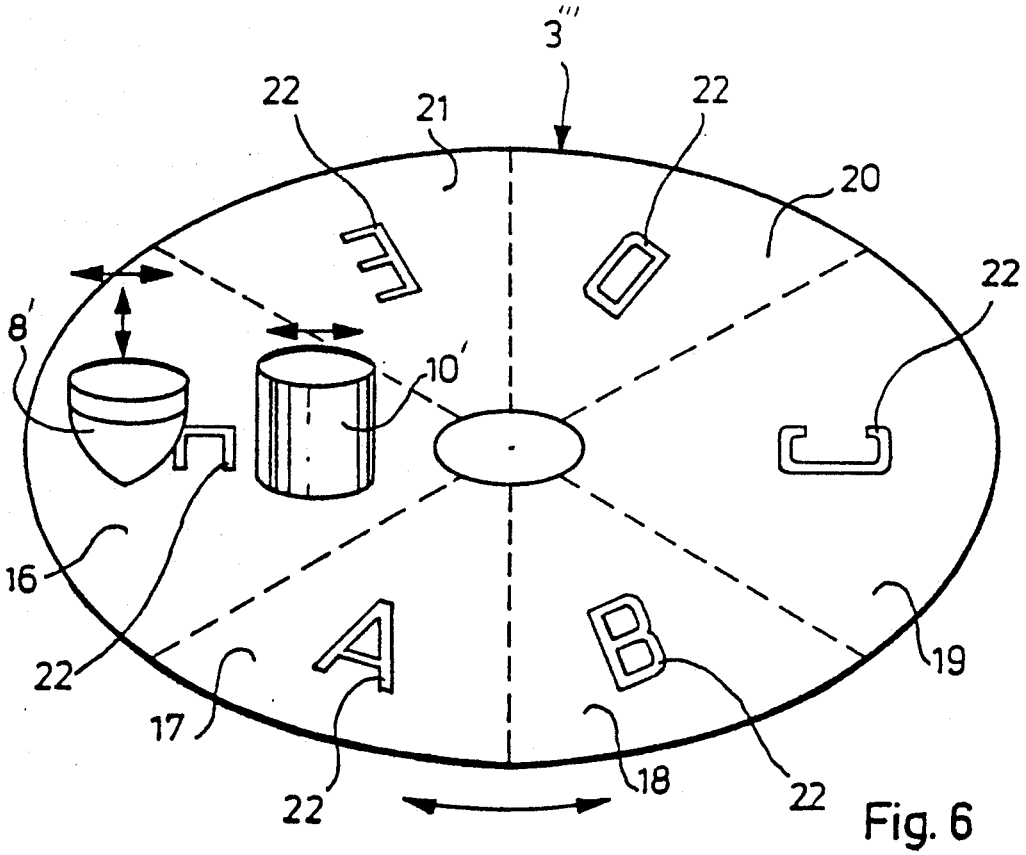
FIG. 6 is a perspective view of a disk-like foil image carrier whose surface is divided into sectors.

FIG. 6 shows a further embodiment of the invention in the form of a foil carrier 3''', which here has the form of a disk. This disk is divided up into individual sectors 16 through 21, each sector being provided with an engraved image 22. The disk-like foil image carrier 3''' is carried on a suitably designed receiving means therefor and is able to be so rotated by a suitable drive that the individual sectors 16 through 21 may be so moved underneath a pad 8' and a doctor pot 10' that an engraved image 22 is inked and the ink can be received by the pad 8'. The individual engraved images 22 may either all be the same or, as illustrated in FIG. 6, they may have different designs. Owing to the disk shape of the foil image carrier 3''', as in the embodiments of the invention illustrated in FIGS. 3 and 4, there is the possibility of changing between images in a fraction of a second by moving a different image into a printing site so that one and the same printing device may be used for different prints without it being necessary to modify the machine.

A printing image carrier of this invention, constituted by a metal foil, has the material properties of a hardened and lapped precision image carrier, which, however, has a thickness of 10 mm to 20 mm, while the metal foil of this invention, on the other hand, is a substantially thinner structure. Advantages resulting from this, such as excellent evenness of surface, long term resistance to flexure and impact, high quality surface finish and good wearing properties, good etching properties as regards to photoengraving and high resistance to corrosion by solvents and diluents for pad printing inks, lead to a large run capability in excess of 500,000. Use of a metal foil as a printing image carrier also leads to price advantages, since material and production costs are only a fraction of those otherwise incurred, and furthermore there is a substantial reduction in stock holding and shipping costs owing to the less weight. Overall costs for photochemical processing also turn out to be lower since metal foils are substantially simpler to cope with than the relatively heavy solid steel image carriers. Thus for an etching operation it is possible to use a conventional plant as is suited for the processing of multilayer material. The superior properties of this foil image carrier also stem from the fact that the metal foil, with a gravure image, exhibits the excellent surface properties of a steel image carrier. A small thickness of such a foil ensures that the foil is able to come into snug engagement with the image-carrier receiving element so that the surface contours of the receiving element are complied with. If the supporting surface of the image-carrier receiving element is flat, the foil image carrier will also assume a flat form. Owing to the fact that the foil image carrier is supported on the flat image-carrier receiving element, against which it is pressed either by a doctor or by a doctor pot or ink pot so that the foil image carrier may snugly engage the image-carrier receiving element, the foil image carrier will precisely comply with the surface contours of the image-carrier receiving element. This image-carrier receiving element may for instance be constituted by a steel plate with a high precision machined surface, receiving element of stone however being preferred, since they represent a "dead" material and therefore warp or deformation is unlikely.

Furthermore an image carrier in accordance with the invention is capable of a long life when used with cemented carbide doctors, since the formation of streaks or the like is practically impossible and gaps between the image carrier and a doctor edge of the doctor pot are made sufficiently small, that is to say in the order of 1 to 2 microns, that wear is minimal.

The metal foil preferably has a martensitic structure. A martensitic structure leads to a high resistance to wear and to enhanced hardness of an image carrier of this invention.

A metal foil of this invention is preferably manufactured of stainless steel, more particularly in the form of a chrome-molybdenum steel such as 7C27Mo2. In accordance with a preferred embodiment of the invention the metal foil consists of stainless steel and has an alloy composition of $<0.4\%$ C, approximately 0.4% Si, approximately 0.6% Mn, approximately 13% Cr and approximately 1% Mo. In another embodiment of the invention the metal foil has a good low-friction surface for engagement with doctor pots having cemented carbide casings and for doctors of tool steel. In accordance with a further possible form of the invention the metal foil is manufactured by electrodeposition of nickel or chromium or of a nickel-chrome alloy. Such metal foils are more particularly utilized in rotary printing presses. In this case an image carrier foil is borne on a roll, which constitutes an image-carrier receiving element. The foil may also consist of copper, which is vapor-coated with stainless steel. In another possible embodiment of the invention the metal foil consists of a spring bronze alloy.

The surface of a foil image carrier of this invention is preferably treated to enhance it. The production of the image is facilitated since the foil has good etching properties. Since a foil of this invention has an anti-corrosion effect, it is possible to use printing inks containing admixed, aggressive solvents and diluents without this causing damage to the foil image carrier.

In accordance with a preferred design of the invention the image carrier may be in the form of a semi-finished product bearing a photosensitive emulsion provided with an opaque protective foil. Such foils may be quite readily provided with a desired gravure image at a place of use, since no complex photochemical apparatus is necessary. Thus, more particularly, a foil image carrier of this invention is substantially more easily handled than a solid steel image carrier.

In accordance with a preferred form of the invention the foil is constituted by a flat foil band bearing one or more engraved images. This foil image carrier is designed as a band image carrier and may have any desired length so that it may be provided with any customized number of engraved images. This band image carrier may be fed onto an image-carrier receiving element with a suitable advancing device so that another image is moved into a line of action of a pad. As a result there is then a possibility of changing the printing image in a minimum of time, whatever the number of prints to be run off from this image is. Thus, for very short runs or for changing the image for each new impression, it is possible to fetch a desired image to a point of printing by systematic advance of the band image carrier. Therefore, make-ready time is reduced to a matter of seconds.

In accordance with a still further possible embodiment of the invention a foil of the invention is designed in the form of a cylindrical foil sleeve. Then by means, for instance, of compressed air or some other suitable holding means the foil sleeve may be attached to a roll and used in a rotary printing press. In this case the foil will be so designed that it is held onto the roll snugly, either by means of a holding device or owing to its dimensions, in such a manner that it takes on surface contours of the roll.

Another embodiment in accordance with the invention is one in which the foil is in the form of a flat foil disk having one or more engraved images. This foil disk is arranged rotatably on an image-carrier receiving element so that different sectors of this foil disk are able to be moved under a pad in sequence. This is another way of making possible changing the printing image so rapidly that different prints, more particularly with an alternation between them, may be processed on a single printing device.

It is possible to arrange a simple way of holding a foil on an image-carrier receiving element if the foil is provided with attachment means, as for example in the form of marginal perforations. Retainer pins provided on a surface of the image-carrier receiving element then fit into the marginal perforations. This form of attachment has additionally an advantage that the foil image carrier may be simply and rapidly secured in position and may be again removed from the image-carrier receiving element. A make-ready time is thus substantially shortened.

In order to further improve printing quality a foil of this invention may have a surface roughness of <2 microns. Such foils are more particularly utilized in closed systems, of a type in which a printing image is inked with an ink pot, whose lower part is designed in the form of a doctor. A roughness of less than 2 microns ensures that no ink is able to leak out of the ink pot, even if the printing device is left standing for some time, for instance overnight or for a weekend.

Independently of the configuration and design of foil image carriers, it is possible for a foil to have a plurality of engraved images. These engraved images may be put into operation by suitably laying the foil image carrier in a printing device.

A still further improvement in printing quality may be ensured by having a surface which bears the gravure image, such that it is able to be compacted. This compaction is brought about by action of a doctor or, respectively, of a doctor pot, which during every printing operation sweeps over the surface of the foil image carrier and exerts a thrust force on the surface of the image carrier.

A pad printing machine having a foil image carrier of this invention is preferably provided with a receiving element for supporting the printing image carrier adjacent to the doctor and the pad, such receiving element having a roughness of <2 microns. This receiving element for the image carrier establishes roughness of the foil image carrier and is therefore manufactured with a high degree of precision. It consists, for instance, of metal, more particularly of steel, of stone, of glass or of some other suitable material.

In order to be able to change a printing image a receiving element for use with an image carrier of this invention is so designed that a printing image carrier of this invention is able to slide on the receiving element. When a desired gravure image has been brought into position, the foil image carrier is locked in this position by suitable holding or attachment devices. In the cases of stationary foil image carriers the same are held by, for instance, locking pins, which fit into marginal perforations thereof While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed or defined as follows:

1. An apparatus for gravure printing comprising:

a receiving element of hard material having a smooth supporting surface polished to a roughness of less than 2 microns;

a flexible foil image carrier of metal with a gravure image on a printing surface thereof and supported on the supporting surface of said receiving element, said flexible foil image carrier having a thickness of 0.02 mm to 0.25 mm, a maximum surface roughness of 3 microns, and a wear resistance for withstanding use with a doctor blade of hard material, said flexible foil image carrier fitting snugly on said supporting surface of said receiving element and complying with surface contours of said receiving element in areas of said foil image carrier resting freely on said receiving element to float thereon by having a freedom of movement relative thereto, while being easily removable therefrom;

a hard metal doctor blade contacting and sliding on the printing surface of said flexible foil and thereby driving said flexible foil image carrier against said supporting surface of said receiving element for bringing said flexible foil image carrier into snug engagement with said supporting surface of said receiving element so that the flexible foil image carrier complies with contours thereof; and a moving means for engaging said flexible foil image carrier and sliding it on said receiving element.

2. An apparatus as in claim 1 wherein the flexible metal foil comprises stainless steel and is in the form of an alloy with the following composition: <0.4% C, approximately 0.4% Si, approximately 0.% Mn, approximately 13% Cr and approximately 1% Mo.

3. An apparatus as in claim 1 wherein the metal foil is of steel with a martensitic structure.

4. An apparatus as in claim 1 wherein the metal foil is in the form of stainless steel.

5. An apparatus as in claim 1 wherein the metal foil is constituted by an electrolytically deposited foil of a material chosen from the group consisting of nickel, chromium, and a chrome-nickel alloy.

6. An apparatus as in claim 1 wherein the foil is provided with a surface adapted to be readily etched.

7. An apparatus for gravure printing as in claim 11 wherein said moving means comprises two spaced rolls positioned on opposite sides of said receiving element and wherein said flexible foil image carrier is an elongated strip which wraps about said rolls.

8. An apparatus for gravure printing as in claim 7 wherein said flexible foil image carrier is drawn off of one of the rolls and taken up on the other of the rolls.

9. An apparatus for gravure printing comprising:

a flexible foil metal image carrier having a plurality of gravure images thereon, said image carrier having a smooth surface and being movable on a smooth surface of a receiving means of said apparatus, said flexible metal foil of said image carrier being adapted to fit snugly against, and move over, said smooth surface of the receiving means and to comply with surface contours thereof, said foil image carrier having, a thickness of 0.22 mm to 0.25 mm, a maximum surface roughness of 3 microns, and a wear resistance for withstanding use with a doctor blade of hard material, said image carrier being in the shape of an elongated band with said plurality of images being spaced therealong, said image carrier further including means for engaging a moving means for moving said image carrier on said smooth surface of said receiving means;

said receiving means for providing said smooth surface for supporting said flexible foil metal image carrier; and said moving means for engaging said image carrier for moving said image carrier on said smooth surface of said receiving means.

10. An apparatus as in claim 9 wherein said moving means comprises two spaced rolls positioned on opposite sides of said receiving element and wherein said means for engaging includes elongated rolled ends of said elongated band for engaging said spaced rolls.

11. An apparatus as in claim 10 wherein said flexible foil image carrier is drawn off of one of the rolls and taken up by the other of the rolls.

12. An apparatus as in claim 9 wherein said smooth surface is polished to a roughness of less than 2 microns.

* * * * *